US007376983B1

(12) United States Patent
Sciarrino

(10) Patent No.: US 7,376,983 B1
(45) Date of Patent: May 27, 2008

(54) DEBRIS CATCH SYSTEM FOR FOOD PREPARATION DRAINS AND OTHER APPLICATIONS

(76) Inventor: Leonard Sciarrino, 9920 Royal Lytham Ave., Bradenton, FL (US) 34202

( * ) Notice: Subject to any disclaimer, the term of this patent is extended or adjusted under 35 U.S.C. 154(b) by 0 days.

(21) Appl. No.: 11/824,656

(22) Filed: Jul. 2, 2007

(51) Int. Cl.
*E03C 1/26* (2006.01)

(52) U.S. Cl. ..... 4/288; 4/289

(58) Field of Classification Search ..... 4/288–292
See application file for complete search history.

(56) References Cited

U.S. PATENT DOCUMENTS 394,213 A 12/1888 Scannell
412,195 A * 10/1889 Marker ..... 4/289
989,410 A 4/1911 Peters

* cited by examiner

*Primary Examiner*—Huyen Le
(74) *Attorney, Agent, or Firm*—Dorothy S. Morse

(57) ABSTRACT

A debris catch assembly used between a plumbing fixture and drain piping. It has two strainers and structure for supporting the larger strainer in a superior position. Both strainers are configured with holes through their side and bottom surfaces, to catch all types of solid debris in waste fluid, including hair. During use, both strainers are rapidly removed and inserted without tools into their usable positions from a location above the plumbing fixture's drain opening. The larger strainer initially catches all of the debris. When it is filled up, it is withdrawn from the drain via finger engagement with a protruding stub, after which collected debris is emptied into a dry waste receptacle. During such cleaning, debris collects in the second strainer. When void of fluid, the second strainer can be removed from the drain for cleaning via a handle having a bent configuration that clears the strainer above it.

20 Claims, 3 Drawing Sheets

DEBRIS CATCH SYSTEM FOR FOOD PREPARATION DRAINS AND OTHER APPLICATIONS

CROSS-REFERENCES TO RELATED APPLICATIONS

None

BACKGROUND OF THE INVENTION

1. Field of the Invention

This invention relates to the field of plumbing traps and strainers, specifically to a plumbing assembly that is used under a plumbing fixture (sink, tub, etc.) to prevent drain blocking clogs. It has two strainers and structure for supporting them in desired positions of use between the plumbing fixture and the drain piping below it, with one strainer located above the other. The first strainer has a larger debris-catching volume than the second strainer and is in a superior position to the second strainer. Both have openings on their side and bottom surfaces configured to catch all debris, including hair and food particles, as well as dimensioned to allow oils and grease to be rinsed substantially from the collected debris. When the first strainer becomes filled with debris and/or wastewater flow through it begins to slow, it is lifted upwardly through the drain opening in the associated plumbing fixture and cleaned by emptying its contents into a dry waste receptacle. While the first strainer is removed from its preferred position of use, the second strainer is typically left in place to catch all debris in any standing water or other waste fluid passing through the plumbing fixture's drain opening. Should the openings in the first strainer become sufficiently blocked with debris to cause standing water in the associated plumbing fixture, the first strainer can be drawn upwardly through the standing water, with the second strainer functioning in a back-up role to catch any debris in the standing waste fluid as it enters into the plumbing fixture's drain opening and before it passes into a connected trap or drain piping, thus avoiding the risk of such debris building up sufficiently in the trap or drain piping to produce a fluid-blocking clog in a position that would be time consuming and/or costly to unblock. An important advantage of the present invention system is that both strainers are inserted and removed through the discharge opening of an associated plumbing fixture from a location above it. Thus, the person using a plumbing fixture having a connected present invention assembly does not have to bend over or drop to the knees to remove collected debris from either strainer. The first strainer can be easily removed via finger engagement with a protruding stub built into its interior surface near to its open top end. The second strainer has an elongated handle that permits easy withdrawal of the entire second strainer after the first strainer has been removed. Also, the handle of the second strainer is sufficiently short and has a bent configuration that allows it to clear the primary strainer above it so that when the second strainer is in its preferred position of use, it does not unseat the first strainer from its preferred positioning, whereby optimal debris catching is achieved.

2. Description of the Related Art

Debris traps for wastewater entering drain piping from a plumbing fixture are necessary to prevent the formation of fluid-blocking clogs that cause slow evacuation of wastewater from the plumbing fixture and/or wastewater accumulation in the plumbing fixture. P-traps or S-traps are typically placed under the fixture from which the wastewater is drained and clean out procedures are accomplished only from under the fixture, a disadvantage for those with arthritis, knee or hip injury, and advanced age. Also, special tools are usually needed to remove a P-trap or S-trap for cleaning, and strength may be required to accomplish the task, again a disadvantage for the infirm, injured, and elderly. Another prior art means of catching wastewater debris are strainers sitting in the uppermost portion of the drain piping connected to a plumbing fixture, such as the common kitchen sink strainer basket. However, many of them are shallow and not effective in high-volume wastewater applications, and/or do not have a filtering configuration that is effective in trapping hair and debris. Further, there is the issue of standing water, wherein once a strainer basket is removed, any standing water or other waste fluid in a plumbing fixture, along with associated debris, immediately moves through the plumbing fixture's drain opening and enters the drain piping below, where it poses a risk for creating a drain blocking clog in a position that would be difficult or expensive to remove.

While plumbing assemblies for trapping food, hair, and other debris are known to comprise multiple straining devices, such as the inventions disclosed in U.S. Pat. No. 989,410 to Peters (1911) and U.S. Pat. No. 394,213 to Scannell (1888). Both of the Peters and Scannell inventions have a superior strainer body with an independent strainer plate beneath it. The present invention has significant advantages over the both inventions and other known prior art, but the main difference is that the strainer plates of the Peters and Scannell inventions are not as easily and promptly removable from their positions of use within drain piping as is the second strainer of the present invention, which requires no separate tool, only finger engagement with its upwardly-directed handle. Also, Peters and Scannell disclosures do not teach the use of two reducing couplers, an adaptor, or the use of compression straps for reduced expense and ease of installation. Also, the tops ends of the Peters and Scannell strainers are seated adjacent to the discharge opening of the associated plumbing fixture, whereas the top flange of the present invention has an open-ended disposal flange immediately below the discharge opening and the top flange of its first strainer held by the lower portion of the disposal flange. Further, the Scannell strainer plate is held in place by a nut and bolt, with the only access to the nut being from below the plumbing fixture. Either a piercing tool or a specially designed wire for piercing (such as a coat hanger wire bent into a hook) would be required to engage one of the strainer plate holes and lift it upwardly from the stop ring that supports it, or a one would have to place at least one hand into the trap and grope through muck and debris to dislodge it from the stop ring so it can be removed. Either way, the Scannell strainer plate cannot be removed without difficulty. In addition, for lifting its strainer from the drain piping, the Peters disclosure reveals a cap connected to a chain that is secured to a portion of the plumbing fixture above the discharge opening. For lifting its strainer from the drain piping, the Scannell disclosure reveals a cross bar within the top strainer opening. Both the cap and cross bar are potential debris trappers, which could lead to premature blocking of waste fluid drainage. The protruding stub of the present invention is much smaller and poses much less of a risk of premature drain blockage. Another problem with the Scannell invention is that collection of debris on its strainer plate traps particles in a direct line with a p-trap, which acts as a sanitary water seal. Also in Scannell, it is contemplated for one to periodically empty its trap portion and remove collected semi-solid debris/grease material for burning. Thus, an operator of the Scannell invention has another task associated with its operation that requires working from below the plumbing fixture. In contrast, with use of the present invention, grease rinses freely away from debris collected in its strainer and does not form fluid-blocking clogs in the drain below. Further, in addition to both of its strainers being easily and readily removable by an operator working from above the plumbing fixture with which they are associated, not requiring the location and use of any tool for rapid removal and/or reseating of its strainers into its usable positions except operator fingers, and the present invention obviating the need for operators and maintenance personnel to bend over or work on the knees to remove drain-blocking debris clogs, which is difficult, time consuming, awkward, and not easily accomplished by those who are injured, infirm, or otherwise impaired in their movement, as well as the expense and delay of hiring a plumber, continued use of the present invention assembly further obviates the need for repeated use of drain cleaning chemicals to remove clogs from pipes and traps, which involve delay and can lead to pipe corrosion and premature pipe failure. Other disadvantages of prior art debris catch devices and procedures, which are overcome by use of the present invention, are the downtime associated with a drain blockage (particularly in business applications where a free-flowing drain is repeatedly needed, as in restaurant, animal grooming, and veterinarian applications), health hazard potential (as in the pet grooming industries, husbanding industries, kennels, and veterinarian applications where ticks associated with loosened pet hair in a drain can climb out of the drain), unpleasant odors associated with standing waste fluid, and the high cost burden placed upon wastewater treatment plants to remove food and other debris entering a drain. In contrast, the present invention debris catch system uses a fresh new approach for drain blockage prevention. A first elongated strainer sits lower in the drain than most prior art strainers, and has a larger catch capacity. Further, a second strainer supported in close proximity to the bottom of the suspended and easily removable first strainer has an elongated handle with a bent upper configuration and dimension that together allow the second strainer to be grasped from above the drain. The bent handle also allows positioning that is easily accessible from above an associated plumbing fixture, while not interfering with the proper support of the first strainer needed for effective debris capture. There is no invention known having the same structure as the present invention or all of its advantages.

BRIEF SUMMARY OF THE INVENTION

The primary object of this invention is to provide a plumbing assembly with two strainers that are stacked vertically for efficient trapping of food particles, hair, and solid debris from waste fluid, and wherein insertion and removal of the strainers from the discharge opening in a plumbing fixture is from a location above it. It is also an object of this invention to provide a plumbing assembly wherein the lower strainer is configured and dimensioned to avoid interfering with proper seating of the upper strainer in its desired position of use. Another object of this invention is to provide a plumbing assembly with strainers that can be rapidly set into their desired positions of use, and rapidly removed for cleaning without the use of tools. It is a further object of this invention to provide a plumbing assembly that is lightweight, durably constructed, and made from corrosion-resistant components. It is also an object of this invention to provide a plumbing assembly with support structure for the strainers that is made from commonly available components for lower manufacturing cost. It is a further object of this invention to provide a plumbing assembly with support structure that can be easily assembled during installation.

The present invention, when properly made and used, will provide a plumbing assembly for use in association with a plumbing fixture (sink, tub, etc.) to prevent drain blocking clogs in the waste piping connected below it. It has two strainers and structure for supporting them in desired positions of use between the plumbing fixture and waste piping, one above the other, both of which can be rapidly set into their desired positions of use and rapidly removed for cleaning without the use of tools. It is contemplated for the strainers and all support components to be lightweight for easy transport and handling, durably constructed, and made from corrosion-resistant components. The first strainer has a larger debris-catching volume than the second strainer and is in a superior position to the second strainer. Both have openings on their side and bottom surfaces configured to catch all debris, including hair and food particles, as well as allow oils and grease to rinse through the collected debris. When the first strainer becomes filled with debris and/or fluid flow through it begins to slow, it is removed upwardly through the drain opening in the associated plumbing fixture and cleaned by emptying its contents into a dry waste receptacle. While the first strainer is removed from its preferred position of use, the second strainer is typically left in place to catch all debris in any waste fluid passing through the plumbing fixture's drain opening. Should the openings in the first strainer become sufficiently blocked with debris to cause standing water in the associated plumbing fixture, the first strainer can be drawn upwardly through the standing water, with the second strainer functioning in a back-up role to catch any debris in the standing waste fluid as it enters into the plumbing fixture's drain opening and before it passes into a connected trap or waste piping, thus avoiding the risk of such debris building up sufficiently in the trap or drain piping to produce a fluid-blocking clog in a position that would be time consuming and/or costly to unblock. An important advantage of the present invention system is that both strainers are inserted and removed through the discharge opening of a plumbing fixture from a location above it. Thus, the person using a plumbing fixture having a connected present invention assembly does not have to bend over or drop to the knees to remove collected debris from either strainer. The first strainer can be easily removed via finger engagement with a protruding stub built into its interior surface close to its open top end. The second strainer has an elongated handle that permits easy withdrawal of the entire second strainer after the first strainer has been removed. Also, the handle of the second strainer has a bent configuration and dimension that clears the primary strainer above it so that when the second strainer is in a preferred position of use, the handle does not unseat the first strainer from its preferred positioning. A small amount of curvature on the end of the handle is preferred, and can further facilitate lifting of the strainer handle upward and out of its desired position of use with only the tip of one human adult finger. Further, since the support structure for the strainers preferably includes an open-ended disposal flange used for garbage disposal installation, a reducing coupler with compression straps, a short adaptor, and a pipe reducer, all commonly available components, manufacturing is more readily accomplished and costs are kept low. Also, since installers are familiar with the strainers' support structure components, assembly is not difficult, even for the first time installer.

The description herein provides preferred embodiments of the present invention but should not be construed as limiting its scope. For example, variations in the width dimension of the compression strap used to secure the upper end of the reducer coupling to the bottom of a sink flange that is otherwise typically used as a part for mounting a food disposal unit, the width dimension of the compression strap used to secure the lower end of the reducer coupling to the short adaptor, the length of the handle as long as it clears the primary strainer and does not unseat it, the number of holes in each strainer, the width dimension of the handle as long as it offers sufficient strength for lifting the strainer body filled with waste fluid debris without bending or otherwise deforming and is not so bulky as to add unwanted weight, and the wall thickness of each strainer as long as they are sufficiently strong and sturdy without unnecessary material waste, other than those shown and described herein, may be incorporated into the present invention. Thus the scope of the present invention should be determined by the appended claims and their legal equivalents, rather than being limited to the examples given.

DETAILED DESCRIPTION OF THE INVENTION

Figure 1:
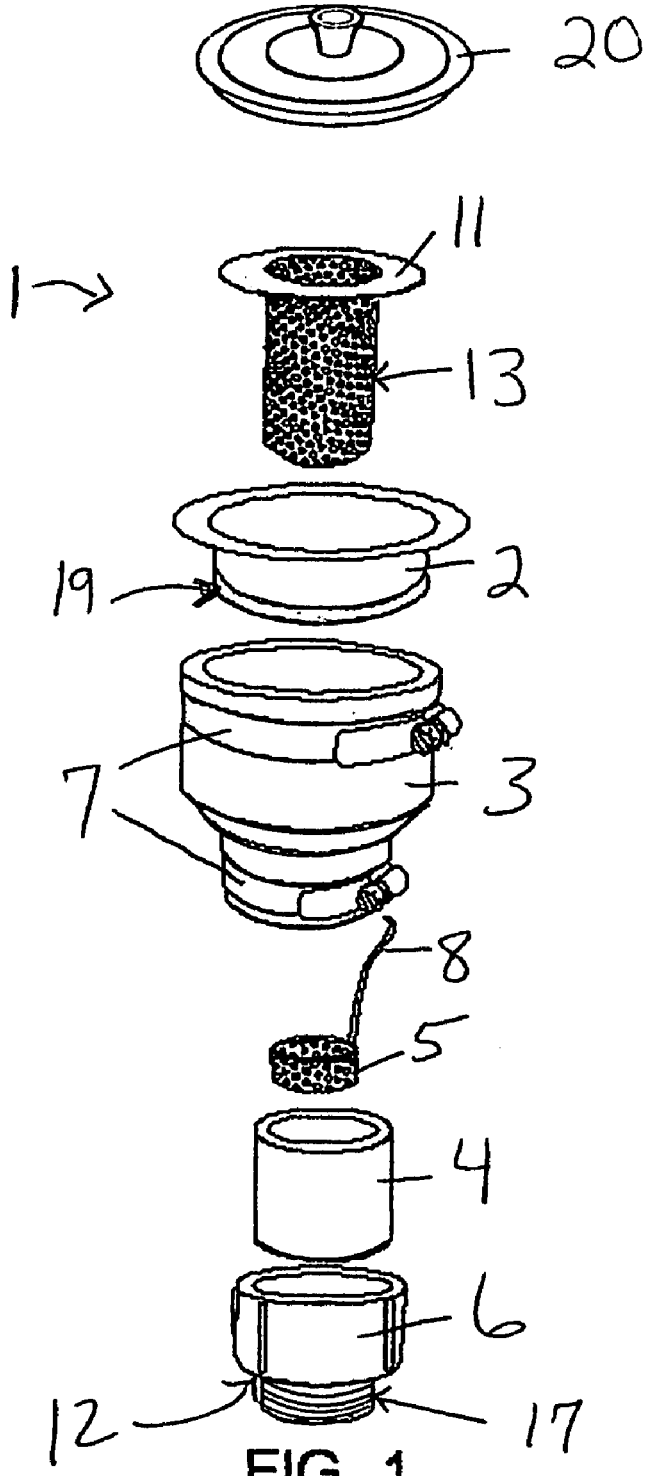
FIG. 1 is an exploded view of the most preferred embodiment of the present invention having a fluid stopper/plug, a larger first strainer poised above an open-ended disposal flange used for garbage disposal installation, with a reducing coupler having compression straps below the disposal flange, the second strainer positioned below the reducing coupler, a short adaptor below the second strainer, and a pipe reducer below the short adaptor. The tailpiece needed for connection of the present invention support structure to waste piping and provided by an installer is not shown.
Figure 2:
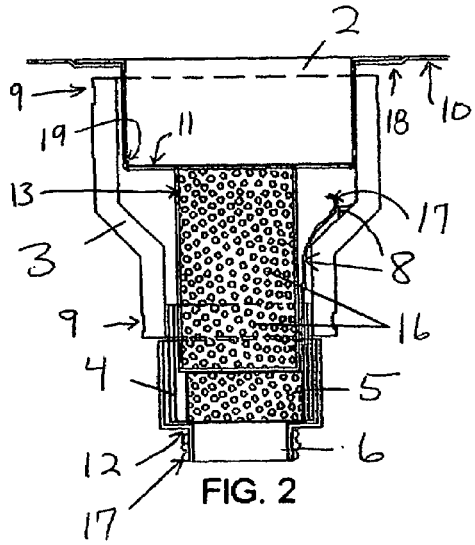
FIG. 2 is a sectional view of the most preferred embodiment of the present invention in assembled condition, with its open-ended disposal flange suspended from the drain opening of a plumbing fixture, the top flange of the first strainer supported by the lower end of the open-ended disposal flange, the second strainer immediately below the first strainer and supported by the interior shoulder of the pipe reducer, with the reducing coupler connected between the disposal flange and the adaptor and the adaptor secured to the pipe reducer.
Figure 3:
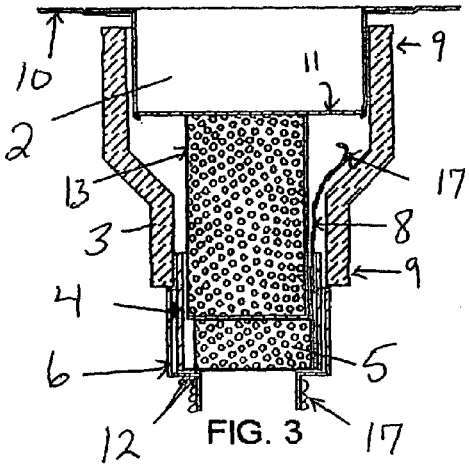
FIG. 3 is a sectional view of the most preferred embodiment of the present invention in assembled condition, with additional shading that more clearly shows the bottom end of the short adaptor and second strainer supported by the interior shoulder of the pipe reducer, and the bent handle of the second strainer positioned between the outside surface of the first strainer and the inside surface of the reducing coupler, with an outside circumferential channel in the upper portion of the reducing coupler in a position where a compression strap would be employed to secure the reducing coupler around the outside surface of the disposal flange, and the outside circumferential channel in the lower portion of the reducing coupler showing where a compression strap would be employed to secure the reducing coupler around the outside surface of the short adaptor.
Figure 4:
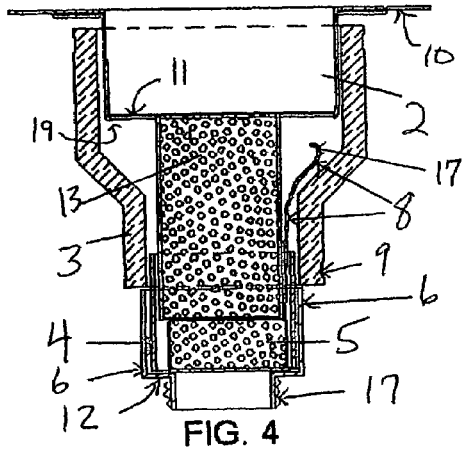
FIG. 4 is a sectional view of the most preferred embodiment of the present invention in assembled condition, similar to that in FIG. 3, showing the first strainer extending into the short adaptor, and also showing threads on the outside surface of the lower end of the pipe reducer.

FIGS. 1-4 disclose the most preferred embodiment of the present invention as a plumbing assembly for use between a plumbing fixture 10 and waste piping (not shown), which includes support structure for strainers 1 and 5 comprising an open-ended disposal flange 2 used for garbage disposal installation, a reducing coupler 3 with compression straps 7, a short adaptor 4, and a pipe reducer 6. The present invention works equally well with large and small volumes of waste fluid (not shown). The tailpiece needed to connect the present invention to waste piping is not shown in the accompanying illustrations, as it is contemplated for the tailpiece to be provided by the installer and sized according to application needs. FIG. 1 also shows a fluid stopper 20 for use in sealing the top opening in disposal flange 2 and the temporary retention of water or other fluid in plumbing fixture 10. FIGS. 2-4 also show disposal flange 2 supported within the drain opening of a plumbing fixture 10 having a drain opening recess 18, and two outside circumferential channels 9 one each on the top and bottom portions of reducing coupler 3, and which each form a shallow conduit on the outside surface of reducing coupler 3 used to seat a compression strap 7 in a fixed position once its is aligned with a channel 9 and tightened around reducing coupler 3 to secure the top end of reducing coupler 3 to the lower end of disposal flange 2 and the bottom end of reducing coupler 3 to the upper end of adaptor 4. In contrast, FIGS. 5-7 show the larger primary strainer 1 in the most preferred embodiment of the present invention, and FIGS. 8-9 show the smaller strainer 5 with a bent handle 8 used as back up for primary strainer 1.

FIGS. 1-4 show larger first strainer 1 poised above an open-ended disposal flange 2 otherwise typically used for a garbage disposal (not shown) installation, with a reducing coupler 3 having compression straps 7 positioned below disposal flange 2, the second strainer 5 positioned below reducing coupler 3, a short adaptor 4 positioned below second strainer 5, and a pipe reducer 6 positioned below short adaptor 4. FIG. 1 is an exploded view of the most preferred embodiment of the present invention with a stopper 20 above first strainer 1, while FIGS. 2-4 show the most preferred embodiment of the present invention in an assembled condition suspended from the drain opening recess 18 of a plumbing fixture 10. The configuration and seating of stopper 20 is not critical and in the alternative stopper 20 could be configured for seating in a lower position within disposal flange 2, although the higher position on top of disposal flange 2 is preferred. FIG. 2 also shows the top flange 11 of first strainer 1 supported by the recessed lower end 19 of the disposal flange 2, and the body of second strainer 5 positioned immediately below the body 13 of first strainer 1, with the bottom perimeter surface of second strainer 5 and supported by the interior shoulder 12 of pipe reducer 6. In addition, FIG. 3 has additional shading that more clearly shows the bottom end of short adaptor 4 and second strainer 5 supported by the interior shoulder 12 of pipe reducer 6, and the bent handle 8 of the second strainer 5 positioned between the outside surface of the first strainer body 13 and the inside surface of the reducing coupler 3, with the circumferential channel 9 in the upper portion of the reducing coupler 3 showing where a compression strap 7 would be used to secure the reducing coupler 3 around the outside surface of the disposal flange 2, and the circumferential channel in the lower portion of the reducing coupler 3 showing where a compression strap 7 would be used to secure the reducing coupler 3 around the outside surface of the short adaptor 4. FIG. 4 is similar to FIG. 3, showing first strainer 1 extending downwardly through reducing coupler 3 and into short adaptor 4, and also showing threads 17 on the outside surface of the lower end of pipe reducer 6, with threads 17 also shown in FIGS. 1-3. In FIG. 4 pipe reducer 6 would be secured with a tailpiece. The upper end of pipe reducer 6 is secured to adaptor 5 via PVC cement or other bonding means. It is contemplated for strainers 1 and 5 to be rapidly removed from their usable positions for cleaning without the use of tools. The tailpiece used to connect the present invention to waste piping is not shown, as the tailpiece would be provided by the installer and sized according to application needs. Also, the clamps 7 are not shown in FIGS. 2-4 so that the indentations representing channels 9 in reducing coupler 3 can be viewed.

Figure 5:
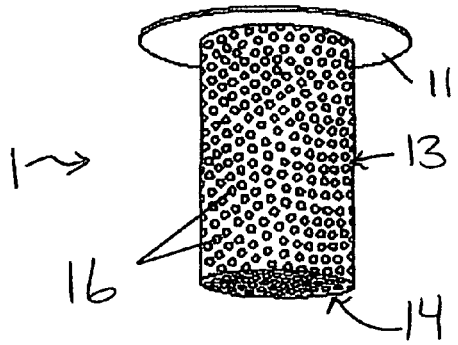
FIG. 5 is a perspective view of the first strainer in the most preferred embodiment of the present invention and showing it having an elongated body, a top flange, and fluid drainage openings throughout its body, including its bottom surface.
Figure 6:
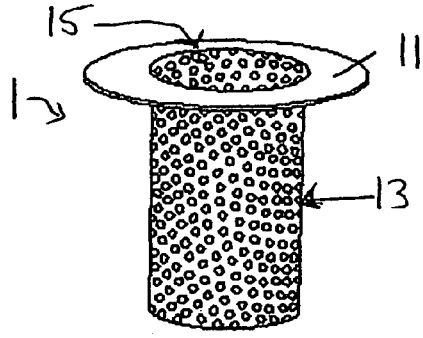
FIG. 6 is a perspective view of the first strainer in the most preferred embodiment of the present invention and showing it having a top flange, fluid drainage openings throughout its body, and a protruding stub or other small but effective grabber device positioned adjacent to the top flange by which the first strainer can be promptly withdrawn upward by a single adult human finger for removal from its usable position.
Figure 7:
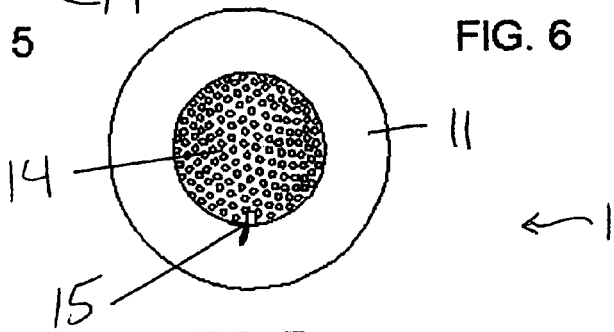
FIG. 7 is a top view of the first strainer in the most preferred embodiment of the present invention and showing its bottom surface having fluid drainage openings therethrough, a top flange, and a protruding stub or other small but effective grabber device positioned adjacent to the top flange by which the first strainer can be promptly withdrawn upward by a single adult human finger for removal from its usable position.

FIGS. 5-7 show the first strainer 1 in the most preferred embodiment of the present invention from different vantage points. FIG. 5 is a perspective view showing first strainer 1 having an elongated body 13, fluid drainage openings 16 throughout its body 13 and bottom surface 14, and a top flange 11 radially extending outwardly from the top surface of body 13. FIG. 6 shows first strainer 1 having fluid drainage openings 16 throughout its body 13 and flange 11, with FIGS. 6 and 7 showing first strainer 1 having a protruding stub or grabber device 15 by which first strainer 1 can be promptly withdrawn by a single adult human finger (not shown) from its usable position within reducing coupler 3 and disposal flange 2. The fluid drainage openings 16 shown in FIG. 7 are in bottom surface 14. Although only one stub 15 is shown, more than one can be used as long as they do not result in any restriction in the entry of debris into strainer body 13. Although FIGS. 1 and 5-6 show elongated body 13 having a preferred cylindrical configuration, other cross-sectional configurations could also be used, such as but not limited to that of a hexagon or octagon. In addition, although a rigid metallic body 13 is preferred, it is not required for the present invention body 13 to be made from rigid metal material, and it may take on the appearance of a bag or sack, if made from sewn filter fabric, mesh material, or any other rigid or non-rigid material capable of performing a filtering function.

Figure 8:
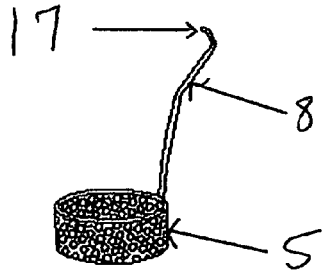
FIG. 8 is a perspective view of the second strainer in the most preferred embodiment of the present invention showing fluid drainage openings throughout its body and a handle having a bent configuration directed away from its body, with an oppositely curved distal end.
Figure 9:
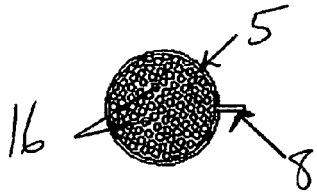
FIG. 9 is a top view of the second strainer in the most preferred embodiment of the present invention that shows it having fluid drainage openings throughout its bottom surface and a handle with a narrow width dimension.

FIGS. 8-9 show second strainer 5 in the most preferred embodiment of the present invention from different vantage points. FIG. 8 shows second strainer 5 having a handle 8 bent away from the body of second strainer 5 with an oppositely curved distal end that permits easy lifting of second strainer 5 from its usable position and upwardly beyond drain opening recess 18. In contrast, FIG. 9 shows second strainer 5 having a handle 8 of narrow width dimension and fluid drainage openings (marked by the number 16) throughout the sides of its body and its bottom surface. As can be seen in FIGS. 2-4, the bend in handle 8 is required to allow handle 8 to have sufficient length dimension to be in a position readily accessible to those needing to remove second strainer 5 for cleaning, while at the same time not being so long as to interfere with the secure seating of the top flange 11 around body 13 within the bottom recessed end 19 of disposal flange 2.

It is contemplated for all materials used for disposal flange 2, reducing coupler 3, short adaptor 4, pipe reducer 6, first strainer 1, second strainer 5, and handle 8 to be corrosion-resistant and durably constructed. Thus, polyvinylchloride (PVC) is a preferred material for disposal flange 2, reducing coupler 3, short adaptor 4, and pipe reducer 6, and stainless steel is a preferred material for first strainer 1, second strainer 5, and handle 8. Another contemplated material for disposal flange 2 is stainless steel material, and reducing coupler 3 can be made from rubberized material. Further, the most preferred materials and manufacture for strainers 1 and 5, but not limited thereto and wherein other substitutions can also be made, are 0.029 Gauge, 304 Grade stainless steel, perforations that are approximately one-eighth of an inch in diameter, perforations having staggered centers, the perforations comprising approximately 40% of the area of body 13, and halyard spiral welding. Where applications permit, lightweight materials are preferred for disposal flange 2, reducing coupler 3, short adaptor 4, and pipe reducer 6, for less costly transport and facilitated installation of components. Also, for low cost and ease of installation by professional installers as well as those with less plumbing experience, it is preferred for disposal flange 2, reducing coupler 3, short adaptor 4, and pipe reducer 6 to comprise commonly available components.

Disposal flange 2 is preferably connected to the discharge opening recess 19 from above plumbing fixture 10 by plumber putty (not shown) to provide a water seal, with reducing coupler 3 mated to the lower end of disposal flange 2 from under plumbing fixture 10. A strap 7 is preferably tightened until there is no movement between disposal flange 2 and reducing coupler 3, with a second strap 7 similarly securing reducing coupler 3 to adaptor 4. A commonly used wrench or socket wrench (not shown) can be employed with each strap 7 to tighten it to the maximum around reducing coupler 3. When the nipple is made from polyvinyl chloride (PVC) and received in an aperture of the same material, bonding on the jobsite with PVC cement is preferred to fasten the exposed part of the nipple to reducing coupler 3.

In many applications, although not limited thereto, reducing coupler 3 will have an upper inside diameter of approximately three inches and a lower inside diameter of approximately two inches, and pipe reducer 6 will have an upper inside diameter of two inches and a lower inside diameter of one-and-one-half inches. Similarly, adaptor 4 often will have a length dimension of approximately two inches. Where reducing coupler 3 has an upper inside diameter of approximately three inches and a lower inside diameter of two inches, the dimensions of handle 8 may include, but is not limited to a generally upwardly-directed lower section having a length dimension of approximately two inches a middle section approximately one inch in length that is bent at an angle away from the body of strainer 5, and a tip having a length dimension less than ten percent of the total length of the combined upper and middles sections that is angled in a direction opposite to that of the middle section.

I claim:

1. A debris catch assembly for use between a plumbing fixture and waste piping, said assembly comprising:

an open-ended disposal flange having an upper portion suspended from the plumbing fixture and a lower portion;

a reducing coupler having a top portion secured to said lower portion of said disposal flange and a bottom portion;

an adaptor secured to said bottom portion of said reducing coupler;

a pipe reducer secured to said adaptor, said pipe reducer having an interior shoulder;

a first strainer having an elongated body, a top flange configured for engagement with said lower portion of said disposal flange and support of said elongated body when it is filled with debris, said first strainer also having side and bottom surfaces with fluid drainage openings therethrough; and a second strainer with a bent handle, side and bottom surfaces with fluid drainage openings therethrough, and a bottom surface configured for support of said strainer when it is filled with debris upon said interior shoulder of said pipe reducer, whereby when said disposal flange is suspended from a plumbing fixture, said reducing coupler is secured to said disposal flange, said adaptor is secured to said reducing coupler, said pipe reducer is secured to said adaptor, and said second strainer is inserted through said adaptor until said bottom surface of said second strainer becomes supported by said interior shoulder of said pipe reducer, said first strainer can then be lowered through said disposal flange until said top flange of said first strainer becomes supported by said lower portion of said disposal flange, and further when said first strainer becomes positioned directly above said second strainer and collects waste fluid debris, and when said first strainer becomes clogged with debris and is lifted upwardly through said disposal flange for cleaning, said second strainer remains supported by said pipe reducer where it can collect waste fluid debris and keep it from entering connected waste piping.

2. The assembly of claim 1 wherein said pipe reducer has a lower end with a threaded outside surface.

3. The assembly of claim 1 wherein said fluid drainage openings in said first strainer create approximately forty percent open area in said side surface of said first strainer.

4. The assembly of claim 1 wherein said fluid drainage openings in said first strainer further comprise one-eighth inch perforations.

5. The assembly of claim 4 wherein said fluid one-eighth inch perforations in said drainage openings of said first strainer further comprise staggered centers.

6. The assembly of claim 1 wherein said fluid drainage openings in said first and second strainers are similar in shape and dimension.

7. The assembly of claim 1 said fluid drainage openings in said first and second strainers are configured and dimensioned for catching hair.

8. The assembly of claim 1 wherein said bent handle of said second strainer has a bent tip configured for easy leverage by a human adult finger in prompt upward withdrawal of said second strainer beyond said disposal flange.

9. The assembly of claim 1 wherein said bent tip is arcuate.

10. The assembly of claim 1 wherein said first strainer further comprises at least one protruding means adapted for engagement with a human adult finger so as to provide leverage for easy lifting of said first strainer upwardly above said disposal flange.

11. The assembly of claim 1 wherein said reducing coupler is secured to said disposal flange via clamping means comprising at least one compression strap.

12. The assembly of claim 11 further comprising two of said compression straps and wherein said reducing coupler has two outside circumferential channels each with a width dimension slightly larger than said compression straps, with each said compression strap positioned within a different one of said channel when tightened around said reducing coupler to secure said reducing coupler said disposal flange and said adaptor.

13. A debris catch assembly for use between a plumbing fixture and waste piping, said assembly comprising:

a disposal flange having an upper portion suspended from the plumbing fixture and a lower portion;

a reducing coupler having a top portion secured to said lower portion of said disposal flange and a bottom portion;

an adaptor secured to said bottom portion of said reducing coupler;

a pipe reducer secured to said adaptor, said pipe reducer having an interior shoulder;

a first strainer having an elongated body, a top flange configured for engagement with said lower portion of said disposal flange and support of said elongated body when it is filled with debris, said first strainer also having side and bottom surfaces with fluid drainage openings therethrough; said first strainer further having at least one protruding means near to said top flange that is adapted for engagement with a human adult finger so as to provide leverage for prompt lifting of said first strainer upwardly above said disposal flange; and a second strainer with a bent handle, side and bottom surfaces with fluid drainage openings therethrough, and a bottom surface configured for support of said strainer when it is filled with debris upon said interior shoulder of said pipe reducer, said bent handle of said second strainer also having a bent tip configured for easy leverage by a human adult finger in prompt upward withdrawal of said second strainer beyond said disposal flange, whereby when said disposal flange is suspended from a plumbing fixture, said reducing coupler is secured to said disposal flange, said adaptor is secured to said reducing coupler, said pipe reducer is secured to said adaptor, and said second strainer is inserted through said adaptor until said bottom surface of said second strainer becomes supported by said interior shoulder of said pipe reducer, said first strainer can then be lowered through said disposal flange until said top flange of said first strainer becomes supported by said lower portion of said disposal flange, and further when said first strainer becomes positioned directly above said second strainer and collects waste fluid debris, and when said first strainer becomes clogged with debris and is lifted upwardly through said disposal flange for cleaning, said second strainer remains supported by said pipe reducer where it can collect waste fluid debris and keep it from entering connected waste piping.

14. The assembly of claim 13 wherein said reducing coupler is secured to said disposal flange via clamping means comprising at least one compression strap.

15. The assembly of claim 13 wherein said reducing coupler is secured to said adaptor via clamping means comprising at least one compression strap.

16. The assembly of claim 14 wherein said reducing coupler is also secured to said adaptor via clamping means comprising at least one compression strap.

17. The assembly of claim 13 wherein said pipe reducer has a lower end with a threaded outside surface.

18. The assembly of claim 13 wherein said fluid drainage openings in said first strainer are approximately one-eighth inch perforations which create an approximately forty percent open area in said side surface of said first strainer.

19. A method for cleaning debris collected in the assembly of claim 13 when standing wastewater with debris is present in the plumbing fixture to which the assembly of claim 13 is connected and for preparing said assembly for additional debris collection, said method comprising the steps of:

providing said assembly in claim 13 wherein said protruding means is configured as a stub, an adult human operator with an extended finger, and a dry waste receptacle;

said operator reaching said finger through the standing water until said finger engages said stub;

said operator using said finger to apply an upwardly-lifting force to said stub until at least a portion of said first strainer is raised above said disposal flange, wherein the standing wastewater with debris passes into said second strainer;

said operator emptying collected debris in said first strainer into said dry waste receptacle;

said operator waiting until all wastewater has drained from second strainer and then reaching said finger through said disposal flange and into said reducing coupler until said finger engages said handle of said second strainer;

said operator using said finger to apply an upwardly-lifting force to said handle until at least a portion of said handle is raised above said disposal flange;

said operator emptying collected debris in said second strainer into said dry waste receptacle;

said operator using said finger against said handle to guide said second strainer through said reducing coupler so that said bottom surface of said second strainer is again supported by said interior shoulder of said pipe reducer; and said operator using said finger against said stub to guide said second strainer through said reducing coupler so that said top flange of said first strainer is again supported by said lower end of said disposal flange.

20. The method of claim 19 wherein said bent handle of said second strainer further comprises a bent tip and wherein each of said steps comprising said operator using said finger to engage said handle further comprise engagement of said finger with said bent tip of said handle.

* * * * *